US010875090B2

(12) United States Patent
Eriksson et al.

(10) Patent No.: US 10,875,090 B2
(45) Date of Patent: Dec. 29, 2020

(54) ASSEMBLY FOR A METAL-MAKING PROCESS

(71) Applicants: ABB SCHWEIZ AG, Baden (CH); ArcelorMittal, Luxembourg (LU)

(72) Inventors: Jan-Erik Eriksson, Västerås (SE); Jean-Marie Galpin, Montigny-les-Metz (FR); Bengt Rydholm, Västerås (SE); Hongliang Yang, Västerås (SE); Jean-Luc Curé, Metz (FR); Nicolas Triolet, Wormhout (FR); Bruno Langlet, Dunkirk (FR); Fredrik Sandberg, Västerås (SE)

(73) Assignees: ABB Schweiz AG, Baden (CH); ArcelorMittal, Luxembourg (LU)

( * ) Notice: Subject to any disclaimer, the term of this patent is extended or adjusted under 35 U.S.C. 154(b) by 0 days.

(21) Appl. No.: 16/468,763

(22) PCT Filed: Nov. 23, 2017

(86) PCT No.: PCT/EP2017/080169
§ 371 (c)(1),
(2) Date: Jun. 12, 2019

(87) PCT Pub. No.: WO2018/108477
PCT Pub. Date: Jun. 21, 2018

(65) Prior Publication Data

US 2019/0314892 A1 Oct. 17, 2019

(30) Foreign Application Priority Data

Dec. 12, 2016 (EP) ..... 16203331

(51) Int. Cl.
*B22D 41/62* (2006.01)

(52) U.S. Cl.
CPC ..... *B22D 41/62* (2013.01)

(58) Field of Classification Search
CPC ..... B22D 41/62
(Continued)

(56) References Cited

U.S. PATENT DOCUMENTS 8,336,605 B2 * 12/2012 Eriksson ..... B22D 41/62 164/468
2017/0368597 A1 12/2017 Yamamoto et al.

FOREIGN PATENT DOCUMENTS

CN 1768984 * 5/2006 ..... B22D 41/62
CN 1768984 A 5/2006
(Continued)

OTHER PUBLICATIONS

European Search Report Application No. EP 16 20 3331 Completed: Jun. 1, 2017; dated Jun. 13, 2017 7 pages.
(Continued)

*Primary Examiner* — Jessee R Roe
*Assistant Examiner* — Michael Aboagye
(74) *Attorney, Agent, or Firm* — Whitmyer IP Group LLC

(57) ABSTRACT

An assembly for a metal-making process, having: a tundish, a submerged entry nozzle (SEN) configured to provide tapping of molten metal from the tundish, and an electromagnetic stirrer arranged around the SEN, the electromagnetic stirrer having a closed and integral SEN-enclosing portion provided with coils for generating a rotating electromagnetic field in the SEN, the SEN-enclosing portion providing a circumferentially closed and integral annular passage through which the SEN extends, wherein the electromagnetic stirrer is immovably mounted relative to the tundish and relative to the SEN.

17 Claims, 1 Drawing Sheet

(58) Field of Classification Search
USPC ..... 266/234, 236; 222/594, 606; 164/502, 164/504, 466, 468, 488
See application file for complete search history.

(56) References Cited

FOREIGN PATENT DOCUMENTS

| | | | | | |
|---|---|---|---|---|---|
| CN | 103203450 | A | | 7/2013 | |
| EP | 0093068 | A1 | | 11/1983 | |
| EP | 1277531 | A2 | | 1/2003 | |
| JP | 3546071563 | | * | 6/1981 | ..... B22D 41/62 |
| JP | S6092064 | A | | 5/1985 | |
| JP | H07108355 | | * | 4/1995 | ..... B22D 41/62 |
| JP | H07108355 | A | | 4/1995 | |
| JP | H10211560 | A | | 8/1998 | |
| JP | 2014518157 | A | | 7/2014 | |
| JP | 2016022495 | A | | 2/2016 | |
| JP | 2016131982 | A | | 7/2016 | |
| JP | 2016524542 | A | | 8/2016 | |
| KR | 950000266 | A | | 1/1995 | |
| KR | 100711397 | | * | 4/2007 | ..... B22D 41/62 |
| KR | 20100001293 | A | | 1/2010 | |
| KR | 20110129262 | | * | 12/2011 | ..... B22D 41/62 |
| RU | 2165461 | C2 | | 4/2001 | |
| RU | 2572949 | C2 | | 1/2016 | |
| WO | 2013000566 | A1 | | 1/2013 | |

OTHER PUBLICATIONS

International Preliminary Report on Patentability Application No. PCT/2017/080169 Completed: Mar. 14, 2019; dated Mar. 14, 2019 13 pages.

International Search Report and Written Opinion of the International Searching Authority Application No. PCT/EP2017/080169 Completed: Feb. 12, 2018; dated Feb. 26, 2018 15 pages.

Written Opinion of the International Searching Authority Application No. PCT/EP2017/080169 dated Nov. 9, 2018 6 pages.

Canadian Office Action Application No. 3,046,832 Completed: Aug. 14, 2019 4 Pages.

Korean Office Action and Translation Application No. 10-2019-7018710 Completed: Aug. 29, 2019 10 Pages.

Canadian Office Action Application No. 3,046,832 Completed: Apr. 14, 2020 4 Pages.

Chinese Office Action and Translation Application No. 201790075783 Completed: May 15, 2020 10 Pages.

Russian Decision of Grant and Translation Application No. 2019121666 Completed: Feb. 14, 2020 12 pages.

Japanese Office Action and Translation Application No. 2019-531301 Completed: Oct. 23, 2019 12 pages.

* cited by examiner

ASSEMBLY FOR A METAL-MAKING PROCESS

TECHNICAL FIELD

The present disclosure generally relates to metal making and in particular to an assembly for a metal-making process.

BACKGROUND

Submerged Entry Nozzles (SEN) are used for controlling the flow pattern in a slab caster mold, and consequently for the slab and final product quality. It is a common practice to purge argon gas into the SEN for the purpose of avoiding nozzle clogging due to oxides building up on the SEN inner wall and for controlling the flow pattern in the mold.

With higher demand on product quality, several problems with conventional SENs have been identified and a swirling flow nozzle has been considered as one effective measure in improving the flow in the mold and thus to improve the product quality.

Electromagnetic stirring of molten metal flowing through the tundish nozzle has been under development for the last twenty years. The principle of an electromagnetic stirrer arranged around the nozzle, is to generate a rotating magnetic field in the nozzle. Eddy currents are thereby induced in the molten metal flowing through the nozzle. This gives rise to an electromagnetic force that rotates the molten metal horizontally in the SEN.

CN 100357049C discloses an electromagnetic swirl nozzle. An electromagnetic swirl means is provided on a moving mechanism around the nozzle, which moving mechanism is movable from the casting position.

SUMMARY

Due to the harsh environment that is present in a metal-making process, such as a steel-making process, moving parts are generally at a higher risk of failure than fixed structures. The electromagnetic swirl means provided in CN 100357049C must typically be moved away from the casting position after about every sixth heat, because at this time the nozzle must be replaced due to wear. This generally applies to any metal-making process. The movable mechanism must thus be moved vertically up and down after a few heats. In the event of a failure of the movable mechanism, the entire assembly for casting will be affected by the downtime required to repair the movable mechanism.

In view of the above, an object of the present disclosure is to provide an assembly for a metal-making process which solves, or at least mitigates, the problems of the prior art.

There is hence provided an assembly for a metal-making process, comprising: a tundish, a submerged entry nozzle, SEN, configured to provide tapping of molten metal from the tundish, and an electromagnetic stirrer configured to be arranged around the SEN, the electromagnetic stirrer having a closed and integral SEN-enclosing portion provided with coils for generating a rotating electromagnetic field in the SEN, wherein the electromagnetic stirrer is configured to be fixedly mounted relative to the tundish and relative to the SEN.

The closed and integrated SEN-enclosing portion is hence non-openable. The SEN-enclosing portion provides a circumferentially closed and integral annular passage through which the SEN is configured to extend. The closed and integrated SEN-enclosing portion has no moving parts, which prolongs the lifetime of the electromagnetic stirrer.

Compared to open-type electromagnetic stirrers, a higher magnetic field strength may be obtained, and magnetic leakage may be reduced.

The electromagnetic stirrer is configured to be fixedly or immovably mounted or arranged relative to the tundish and relative to the SEN. The electromagnetic stirrer is configured to be mounted to a fixed structure, typically directly or indirectly to the tundish body.

By means of a fixedly arranged closed-type electromagnetic stirrer, a higher reliability of the assembly may be provided.

According to one embodiment the SEN-enclosing portion has a through-opening forming a channel configured to receive the SEN, wherein the channel has seamless inner walls along the inner circumference thereof.

One embodiment comprises an SEN-cutting device configured to be mounted to the tundish and arranged below the tundish.

According to one embodiment the electromagnetic stirrer is configured to be mounted to the SEN-cutting device.

According to one embodiment the electromagnetic stirrer is configured to be mounted to an underside of the SEN-cutting device.

One embodiment comprises a locking device, wherein the SEN has a first nozzle part configured to extend from the tundish, and a second nozzle part configured to be removably attached to the first nozzle part by means of the locking device.

According to one embodiment the electromagnetic stirrer is configured to be mounted onto the locking device.

According to one embodiment the electromagnetic stirrer is configured to be mounted to a bottom of the tundish.

According to one embodiment the electromagnetic stirrer is integrated with the locking device.

According to one embodiment the metal-making process is a steel-making process.

Generally, all terms used in the claims are to be interpreted according to their ordinary meaning in the technical field, unless explicitly defined otherwise herein. All references to "a/an/the element, apparatus, component, means, etc.," are to be interpreted openly as referring to at least one instance of the element, apparatus, component, means, etc., unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

The present disclosure relates to an assembly for a metal-making process, typically a continuous casting process, for example a steel-making process, an aluminum-making process, or a metal-alloy making process.

The assembly includes a tundish, an SEN configured to provide tapping of molten metal from the tundish, and an electromagnetic stirrer configured to be mounted around the SEN. The electromagnetic stirrer is configured to be fixedly mounted relative to the tundish and relative to the SEN. The electromagnetic stirrer is hence configured to be mounted immovably relative to the tundish and the SEN. In particular, the electromagnetic stirrer is configured to be mounted to a fixed structure, which is fixed relative to the tundish and relative to the SEN. This fixed structure may for example be the tundish itself, a SEN-cutting device mounted to the tundish, or a locking device, typically mounted to the tundish and configured to attach and lock two longitudinally extending nozzle parts of an SEN together, as will be described in more detail in the following.

In use of the assembly, molten metal is tapped into the tundish from a ladle. The flow of molten metal drained from the tundish may be controlled through the SEN, typically by means of a stopper rod. Below the SEN is a mold into which the molten metal is drained and where the molten metal is partially solidified. The partially solidified metal is then moved by gravity from the mold, normally through an arrangement of rollers for shaping and for cooling. In this manner, billets, blooms or slabs may be obtained.

Figure 1:
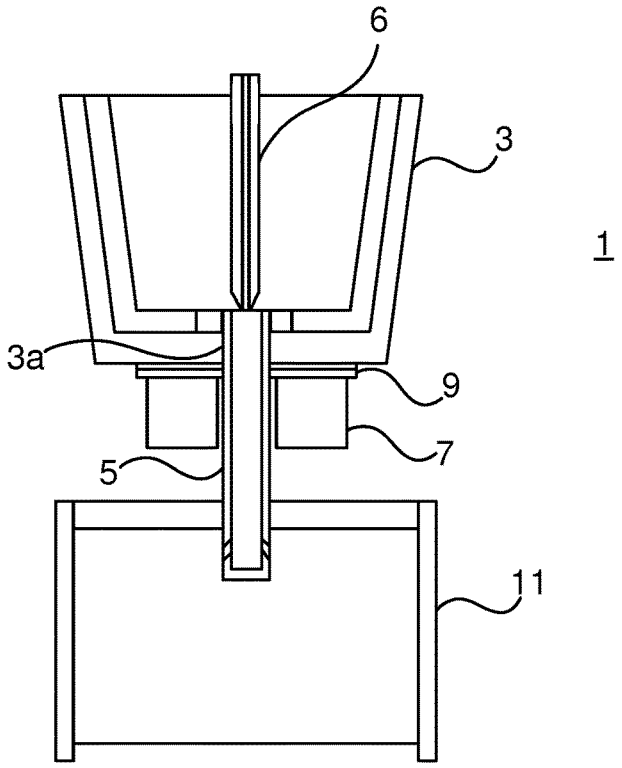
FIG. 1 schematically shows a longitudinal section of an example of an assembly for a metal-making process.

FIG. 1 shows a first example of an assembly for a metal-making process. The assembly 1 comprises a tundish 3, which is a metallurgical vessel provided with a bottom tapping hole 3*a*, and an SEN 5. The SEN 5 is configured to be arranged in the bottom tapping hole 3*a* of the tundish 3, to thereby allow tapping of molten metal from the tundish 3.

The exemplified SEN 5 is a monolithic SEN and is configured to extend into a mold 11 arranged below the tundish 3 and the SEN 5, so that molten metal flowing through the SEN 5 can flow into the mold 11 by means of gravity. The assembly 1 may according to one example include a stopper rod 6 provided with an argon gas inlet, to allow an inflow of argon gas into the stopper rod 6. The stopper rod 6 has an axial channel through which the argon gas is able to flow, and an argon gas outlet connected to the argon gas inlet, to allow argon gas to flow through the stopper rod 6 into the SEN 5. The flow of molten metal may thus be controlled in the SEN 5 to avoid nozzle clogging. The stopper rod 6 is additionally configured to be moved vertically up and down to regulate the flow-rate of the molten metal flowing from the tundish 3 to the mold 11 via the SEN 5.

The exemplified assembly 1 furthermore includes an electromagnetic stirrer 7 and an SEN-cutting device 9. The electromagnetic stirrer 7 is a closed-type electromagnetic stirrer 7, in the sense that it has no moving parts in the portion surrounding the SEN 5. The closed and integral SEN-enclosing portion, or annular end portion, of the electromagnetic stirrer 7, configured to surround the SEN 5 is hence non-openable. The annular end portion is thus integrated, although it should be understood that the annular end portion may comprise a number of distinct components, such as a magnetic core and coils wound around the core. The annular end portion forms a channel configured to receive the SEN 5. This channel may be said to be seamless in the circumferential direction, along the inner circumference of the channel. Since the electromagnetic stirrer 7 is of a closed type, the electromagnetic stirrer 7 cannot during installation be opened and placed around the SEN 5 from two sides of the SEN 5, before closing. Instead, during installation, the electromagnetic stirrer 7 is threaded over the SEN 5 in the axial direction thereof.

The SEN-cutting device 9 is configured to cut off the SEN 5. The SEN-cutting device 9 is in particular configured to make a cross-sectional cut of the SEN 5. The SEN-cutting device 9 is typically only used in an emergency situation, in the event that the stopper rod 6 is inoperable or destroyed. The SEN-cutting device 9 is according to the present example fixedly mounted to the underside of the tundish 3. The electromagnetic stirrer 7 is fixedly mounted to the SEN-cutting device 9. The electromagnetic stirrer 7 is hence indirectly mounted to the tundish 3. According to the present example, the electromagnetic stirrer 7 is mounted to the underside of the SEN-cutting device 9. The electromagnetic stirrer 7 is attached to the SEN-cutting device 9 by means of fasteners. Examples of suitable fasteners are screws and/or bolts.

Figure 2:
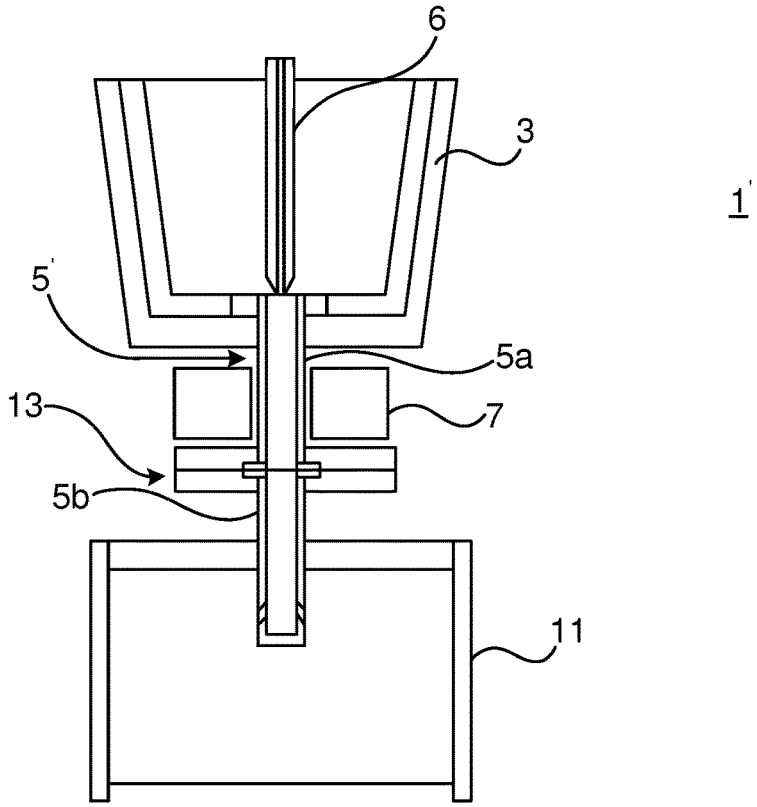
FIG. 2 schematically shows a longitudinal section of another example of an assembly for a metal-making process.

FIG. 2 shows another example of an assembly 1' for a metal-making process. The assembly 1' is similar to assembly 1 described above with reference to FIG. 1. Hence, the assembly 1' comprises a tundish 3, a stopper rod 6, an electromagnetic stirrer 7, an SEN 5', and a locking device 13, which is a nozzle-change device.

The SEN 5' is however not a monolithic SEN, like SEN 5. SEN 5' includes a first nozzle part 5*a* and a second nozzle part 5*b*. The first nozzle part 5*a* and the second nozzle part 5*b* are configured to be connected by means of the locking device 13. The first nozzle part 5*a* is configured to be connected to, or is integral with the tundish 3. The second nozzle part 5*b* is configured to extend into the mold 11.

The first nozzle part 5*a* and the second nozzle part 5*b* may for example have respective end flanges configured to face each other, forming an interface between the two nozzle parts 5*a* and 5*b*. The locking device 13 may be configured to lock the two end flanges to each other. By means of the locking device 13, the second nozzle part 5*b* may in a simple manner be connected to and disconnected from the first nozzle part 5*a*, in order to replace the second nozzle part 5*b* when necessary. The first nozzle part 5*a* is hence configured to be removably attached to the second nozzle part 5*b* by means of the locking device 13.

The electromagnetic stirrer 7 may be mounted to the locking device. The locking device 13 may for example have a horizontal top surface, and the electromagnetic stirrer 7 may be configured to be fixedly attached to the horizontal top surface. The locking device 13 is fixedly attached to the SEN 5', which in turn is fixedly attached to the tundish 3, and the electromagnetic stirrer 7 is fixedly attached to the locking device 13. To this end, the electromagnetic stirrer 7 is indirectly connected or attached to the tundish 3.

As an alternative to the electromagnetic stirrer being fixedly attached to the locking device, the electromagnetic stirrer could be fixedly attached directly to the tundish. In this case, the electromagnetic stirrer would typically be fixedly attached to the underside or bottom of the tundish. As yet another alternative, the electromagnetic stirrer could be integrated with the locking device.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. An assembly for a metal-making process, comprising:

a tundish, a submerged entry nozzle (SEN) configured to provide tapping of molten metal from the tundish, and an electromagnetic stirrer arranged around the SEN, the electromagnetic stirrer having a closed and integral SEN-enclosing portion provided with coils for generating a rotating electromagnetic field in the SEN, the SEN-enclosing portion providing a circumferentially closed and integral annular passage through which the SEN extends, wherein the SEN-enclosing portion is non-openable, wherein the electromagnetic stirrer is mounted to a fixed structure which is fixed directly or indirectly relative to the SEN such that the electromagnetic stirrer is immovable relative to the tundish and SEN.

2. The assembly as claimed in claim 1, wherein the annular passage forms a channel configured to receive the SEN, wherein the channel has seamless inner walls along the inner circumference thereof.

3. The assembly as claimed in claim 1, comprising an SEN-cutting device configured to be mounted to the tundish and arranged below the tundish.

4. The assembly as claimed in claim 3, wherein the electromagnetic stirrer is configured to be mounted to the SEN-cutting device.

5. The assembly as claimed in claim 4, wherein the electromagnetic stirrer is configured to be mounted to an underside of the SEN-cutting device.

6. The assembly as claimed in claim 1, comprising a locking device, wherein the SEN has a first nozzle part configured to extend from the tundish, and a second nozzle part configured to be removably attached to the first nozzle part by means of the locking device.

7. The assembly as claimed in claim 6, wherein the electromagnetic stirrer is configured to be mounted onto the locking device.

8. The assembly as claimed in claim 6, wherein the electromagnetic stirrer is configured to be mounted to a bottom of the tundish.

9. The assembly as claimed in claim 6, wherein the electromagnetic stirrer is integrated with the locking device.

10. The assembly as claimed in claim 1, wherein the metal-making process is a steel-making process.

11. The assembly as claimed in claim 2, comprising an SEN-cutting device configured to be mounted to the tundish and arranged below the tundish.

12. The assembly as claimed in claim 2, comprising a locking device, wherein the SEN has a first nozzle part configured to extend from the tundish, and a second nozzle part configured to be removably attached to the first nozzle part by means of the locking device.

13. The assembly as claimed in claim 2, wherein the metal-making process is a steel-making process.

14. The assembly as claimed in claim 1, wherein the SEN-enclosing portion has no moving parts.

15. The assembly as claimed in claim 1, wherein the fixed structure is the tundish.

16. The assembly as claimed in claim 1, wherein the SEN is monolithic.

17. The assembly as claimed in claim 1, wherein the electromagnetic stirrer is threadable over the SEN in an axial direction of the SEN during installation.

* * * * *